US007639153B2

(12) United States Patent
Ford et al.

(10) Patent No.: US 7,639,153 B2
(45) Date of Patent: Dec. 29, 2009

(54) USER INTERFACE FOR ELECTRONIC DEVICES

(75) Inventors: Timothy D. F. Ford, Beaconsfield (CA); Stephane Gascon, Mascouche (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 261 days.

(21) Appl. No.: 11/944,038

(22) Filed: Nov. 21, 2007

(65) Prior Publication Data

US 2008/0129529 A1 Jun. 5, 2008

Related U.S. Application Data

(60) Division of application No. 11/056,232, filed on Feb. 14, 2005, now Pat. No. 7,315,036, which is a continuation-in-part of application No. 10/692,294, filed on Oct. 23, 2003, now Pat. No. 7,023,004.

(60) Provisional application No. 60/543,937, filed on Feb. 13, 2004.

(51) Int. Cl.
*G08B 21/00* (2006.01)

(52) U.S. Cl. ..... 340/686.1; 340/500; 340/572.6; 340/691.1; 340/693.5

(58) Field of Classification Search ..... 340/686.1, 340/500, 540, 572.1, 572.6, 572.8, 691.1, 340/693.5

See application file for complete search history.

(56) References Cited

U.S. PATENT DOCUMENTS

| | | | |
|---|---|---|---|
| 3,421,227 | A | 1/1969 | Turner et al. |
| 4,319,144 | A | 3/1982 | King et al. |
| 4,423,456 | A | 12/1983 | Zaidenweber |
| 4,473,757 | A | 9/1984 | Farago et al. |
| 4,517,555 | A | 5/1985 | Marsocci et al. |
| 4,595,978 | A | 6/1986 | Sheffield |
| 4,906,858 | A | 3/1990 | Gesin |
| 4,929,936 | A | 5/1990 | Friedman et al. |
| 4,947,126 | A | 8/1990 | May et al. |
| 4,989,114 | A | 1/1991 | Storti et al. |
| 5,414,405 | A | 5/1995 | Hogg et al. |

(Continued)

FOREIGN PATENT DOCUMENTS

| | | | |
|---|---|---|---|
| EP | 0 289 625 | A1 | 11/1988 |

(Continued)

*Primary Examiner*—Daryl Pope
(74) *Attorney, Agent, or Firm*—Goudreau Gage Dubuc

(57) ABSTRACT

A user interface for an electronic device, the interface comprising first and second parts arranged for relative displacement, said first part comprising a magnet and said second part comprising a first hall effect sensor for sensing a displacement of said magnet along a first axis and a second hall effect sensor for sensing a displacement of said magnet along a second axis, wherein said magnet moves relative to said first and second hall effect sensors in response to movement of said second part relative to said first part; a plurality of switch settings, each of said switch settings comprised of a unique combination of a magnet position along said first axis and a magnet position along said second axis; and control electronics coupled to said first and second hall effect sensors for converting the combination of a current position of said magnet along said first axis and a current position of said magnet along said second axis into a selected one of said plurality of switch settings.

7 Claims, 5 Drawing Sheets

U.S. PATENT DOCUMENTS 5,623,550 A 4/1997 Killion
5,804,829 A 9/1998 Palmer
5,842,777 A 12/1998 McDermott
5,929,777 A 7/1999 Reynolds
6,002,212 A 12/1999 Gagnot et al.
6,445,132 B1 9/2002 Ford
6,670,847 B1 12/2003 Rokhsaz
6,686,911 B1 * 2/2004 Levin et al. ..... 345/184
6,825,577 B2 11/2004 Soto et al.
7,038,667 B1 * 5/2006 Vassallo et al. ..... 345/184
7,233,313 B2 * 6/2007 Levin et al. ..... 345/156
2002/0190847 A1 12/2002 Armstrong

FOREIGN PATENT DOCUMENTS

WO WO-97/16738 A1 5/1997

* cited by examiner

USER INTERFACE FOR ELECTRONIC DEVICES

This application is a Divisional of U.S. patent application Ser. No. 11/056,232, filed on Feb. 14, 2005 now U.S. Pat No. 7,315,036. U.S. patent application Ser. No. 11/056,232 is in turn a Continuation-In-Part (CIP) application of U.S. patent application Ser. No. 10/692,294 filed Oct. 23, 2003, now U.S. Pat. No. 7,023,004 issued on Apr. 4, 2006 and also claims priority of a commonly assigned U.S. provisional application entitled "Multifunction Multi-Spectrum Signalling Device", which was filed on Feb. 13, 2004 and assigned the Ser. No. 60/543,937. The entire contents of the foregoing applications are herein incorporated by reference.

FIELD OF THE INVENTION

The present invention relates to a multifunction multi-spectrum signalling device. In particular the present invention relates to a signalling device which emits electromagnetic radiation such as visible or invisible light according to reprogrammable patterns and at reprogrammable intensities stored in the device's memory. The device also provides the ability to receive, store and transmit data to reprogram the devices functions and/or change the devices its control signatures.

BACKGROUND OF THE INVENTION

The prior art reveals a variety of small light emitting devices to be worn by a user not only for the purposes of illumination but also for notification, alerting and identification. Recent improvements in high-intensity light emitting diodes (LEDs) have allowed arrays of small high-intensity lights of differing colours or wavelengths to be combined in a single signalling device. By equipping these prior art devices with a suitable microprocessor or microcontroller, a series of signalling programs and a multi-position switch for program selection, the array of LEDs can be turned on and off and their intensity varied according to the selected program.

There also exist in the art portable signalling devices comprising an array of user selectable LEDs, with at least one diode emitting light in the visible light range and at least one emitting light in the infra-red range. As is known in the art, devices operating in the infra-red range are not visible to the naked eye, but are typically visible for many miles to an observer equipped with, for example, a night vision system including a suitable infra-red image intensifier. In these prior art devices, the user typically selects the light to be emitted via a switch mechanism, with one favoured prior art switch being the bezel mounted multi-position rotary dial for rotation in a clockwise or counter-clockwise direction.

SUMMARY OF THE INVENTION

There is disclosed a signalling device for copying a series of flashes emitted by an electromagnetic radiation emitting source. The device comprises an emission module comprising at least one electromagnetic radiation emitting element, at least one photosensitive element and a memory, and a switch for selecting between a record mode and a playback mode. When in the record mode, the series of light flashes using are detected by the at least one photosensitive element and stored in the memory as a control signature and when in the playback mode the at least one light emitting element is illuminated according to the stored control signature.

Additionally, there is disclosed a reprogrammable multi-mode electromagnetic radiation emitting device. The device comprises an emission module comprising at least one electromagnetic radiation emitting source, a first terminal, a second terminal and a polarity responsive controller interposed between the at least one electromagnetic radiation emitting source and the first and second terminals, a DC power source comprising a positive terminal and a negative terminal, a polarity switch selectively defining either interconnections between (a) the first and positive terminals and (b) the second and negative terminals, or interconnections between (a) the first and negative terminals and (b) the second and positive terminals, and a user interface for entering a control signature. The polarity responsive controller comprises an instruction bank comprising a plurality of control signatures, a switch for selecting a control signature from the control signatures, a power supply circuit activated by the interconnections between (a) the first and positive terminals and (b) the second and negative terminals, and supplying, when activated, power from the DC power source to the at least one electromagnetic radiation emitting source according to the selected control signature, thereby causing the at least one source to emit electromagnetic radiation according to the control signature, and a reprogramming circuit activated by the interconnections between (a) the first and negative terminals and (b) the second and positive terminals, and replacing, when activated, the selected control signature with the new control signature.

Also, there is disclosed a signalling device comprising an emission module comprising at least one light emitting element, a memory, a bi-directional wireless interface, and a switch for selecting between at least an upload mode and a download mode. When in the upload mode, data received by the wireless interface is stored in the memory, and when in the download mode, data stored in the memory is transmitted by the wireless interface.

Additionally, there is disclosed a user interface for an electronic device. The interface comprises first and second parts arranged for relative displacement, the first part comprising a magnet and the second part comprising a first hall effect sensor for sensing a displacement of the magnet along a first axis and a second hall effect sensor for sensing a displacement of the magnet along a second axis, wherein the magnet moves relative to the first and second hall effect sensors in response to movement of the second part relative to the first part, a plurality of switch settings, each of the switch settings comprised of a unique combination of a magnet position along the first axis and a magnet position along the second axis and control electronics coupled to the first and second hall effect sensors for converting the combination of a current position of the magnet along the first axis and a current position of the magnet along the second axis into a selected one of the plurality of switch settings.

Other objects, advantages and features of the present invention will become more apparent upon reading of the following non-restrictive description of illustrative embodiments thereof, given by way of example only with reference to the accompanying drawings.

DETAILED DESCRIPTION OF THE ILLUSTRATIVE EMBODIMENTS

Figure 1:
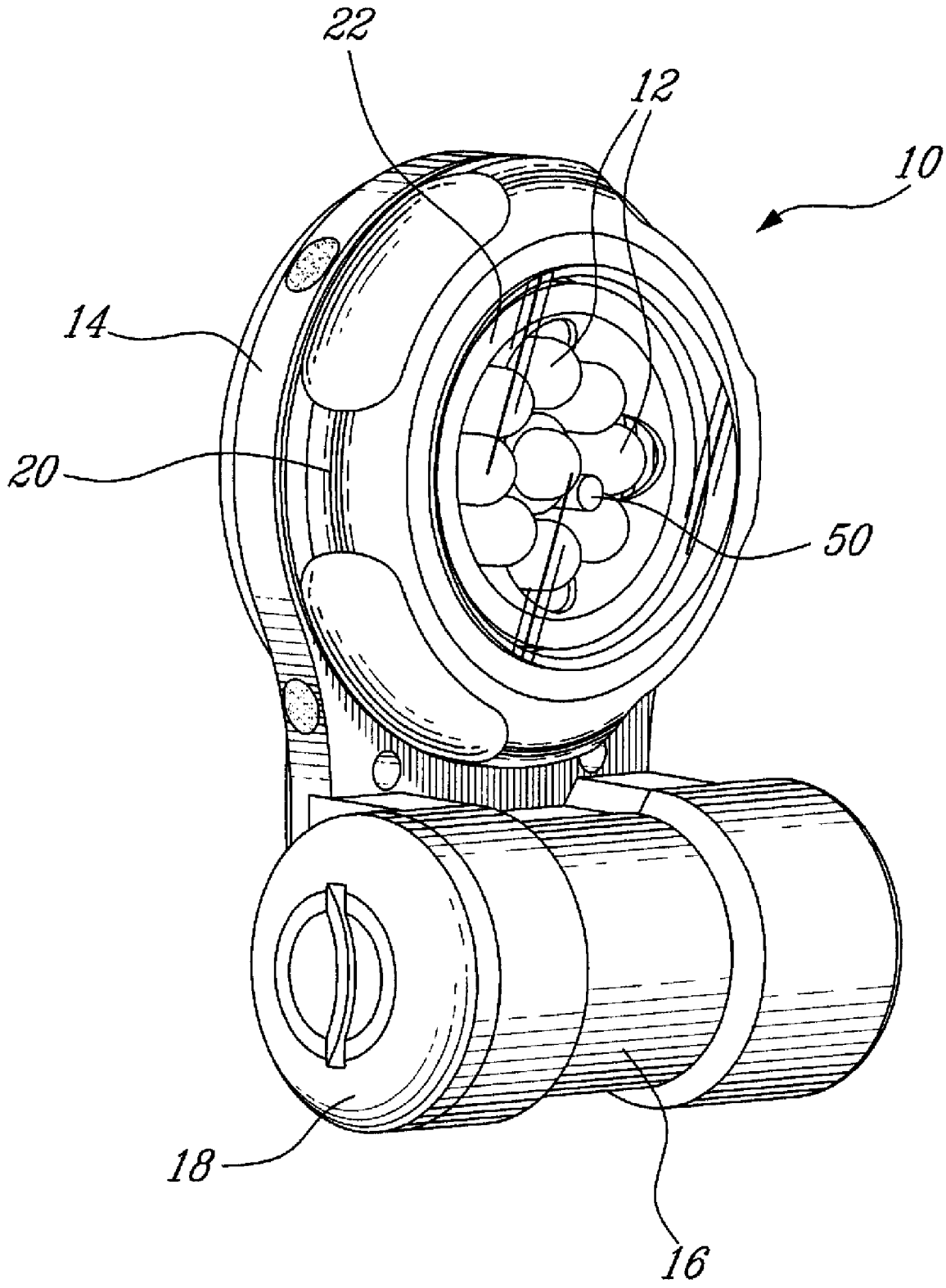
FIG. 1 is a front elevated view of a multifunction multi-spectrum signalling device in accordance with an illustrative embodiment of the present invention.

Referring now to FIG. 1, a multifunction multi-spectrum signalling device in accordance with an illustrative embodiment of the present invention will be described. The multifunction multi-spectrum signalling device, generally referred to using the reference numeral 10, comprises an emission module comprising one or more electromagnetic radiation emitting devices, or light emitting elements 12, such as LEDS, xenon strobes, incandescent lamps or the like. Depending on the configuration, and as will be seen below, these elements may operate in both the visible spectrum and non-visible spectrum, for example known in the art are LEDs that emit light in the ultraviolet (UV) bands or infrared bands. In a particular illustrative embodiment the light emitting elements 12 comprise one or more laser diodes operating at 1550 nm. As known in the art, lasers operating at 1550 nm are visible over great distances, typically in excess of 20 miles. In an alternative illustrative embodiment the light emitting elements 12 comprise a combination of a thermal emitting and infrared device (also known as a fusion device). The light emitting elements 12 are driven by electronics sealed within the device housing 14 and powered by a battery encased in a battery compartment 16 which is sealed by a battery compartment cap 18. A bezel mounted multi-position rotary switch 20 mounted to the device housing 14 via a hub and transparent lens assembly 22. The multi-position rotary switch 20 provides the user with means to not only activate and deactivate the light emitting elements 12 but also select from one of a number of programs, typically limited by the number of switch positions, which provide a number of different activation programs (or control signatures or signalling instructions), such as flashing in different sequences and the like.

Figure 2A:
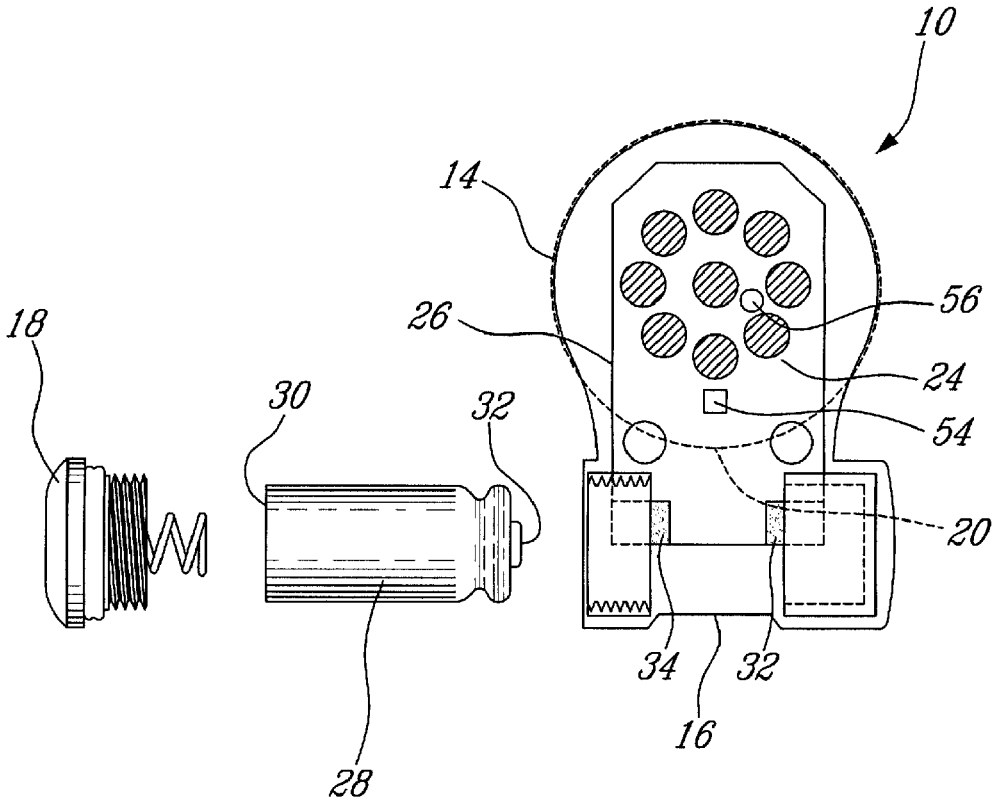
FIG. 2*a* is a front plan view of a multifunction multi-spectrum signalling device with the housing removed in accordance with an illustrative embodiment of the present invention.

Referring now to FIG. 2*a*, the light emitting elements 12 are mounted on a first surface 24 of a Printed Circuit Board (PCB) 26 which is encapsulated within the device housing 14. The light emitting elements 12 are powered by a battery 28 the anode 30 and cathode 32 of which, when inserted into the battery compartment 16 and sealed therein using the battery compartment cap 18, come into respective contact with a first contact surface 34 and a second contact surface 36 etched into the first surface 24 of a Printed Circuit Board (PCB) 26.

Figure 2B:
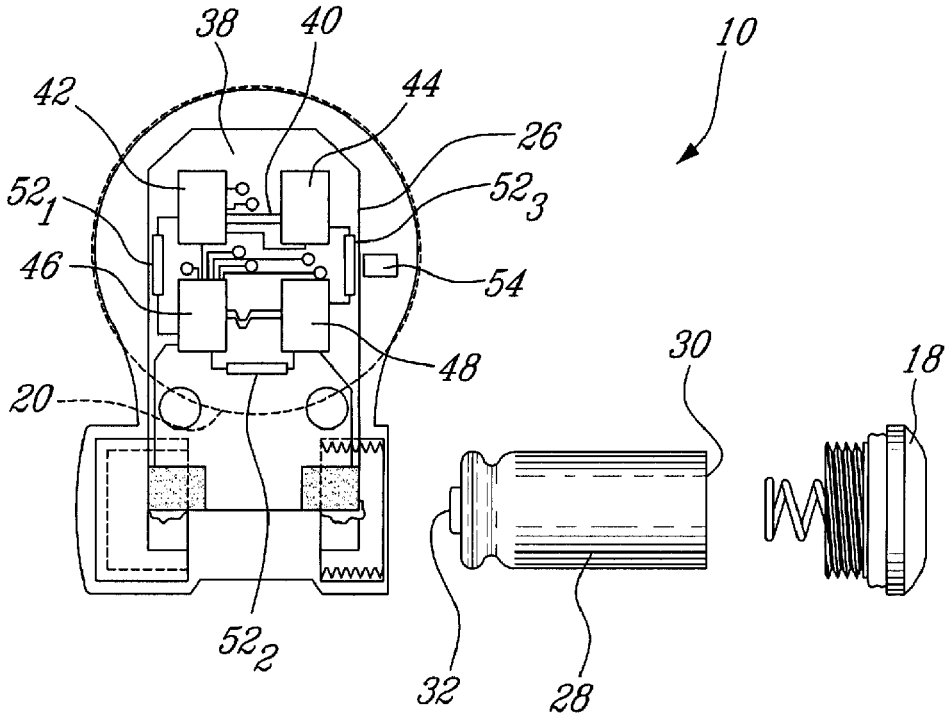
FIG. 2*b* is a rear plan view of a multifunction multi-spectrum signalling device with the housing removed in accordance with an illustrative embodiment of the present invention.

Referring now to FIG. 2*b*, on a second surface 38 of the PCB 26, a series of traces as in 40 are etched for guiding electrical signals between various electronic components which are mounted on the second surface 38 of the PCB 26. Electronic components include, for example, and depending on configuration, one or more integrated circuits (ICs). ICs include, for example:

a microprocessor (CPU) 42,

Read Only Memory (ROM) and/or Electrically Erasable Programmable Read Only Memory (EEPROM) 44;

drivers 46 for driving the light emitting devices 12; and in a particular embodiment, and as will be discussed below, components for a wireless interface 48.

Other electronic components may also be included as required such as individual transistors, oscillators, resistors, capacitors and the like. Additionally, switch matrix 50 comprised of an array of reed switches as in $\mathbf{52}_1$, $\mathbf{52}_2$, and $\mathbf{52}_3$ (or similar devices such as hall effect sensors) are provided which react with a small magnet 54 mounted in the rotary switch 20 (and moveable therewith), indicating to the microprocessor 42 the position of the rotary switch (not shown), and thereby allowing for user input. Alternatively, a variety of mechanical switches (not shown) could also be used.

A variety of methods can be used to attach the ICs and other components to the PCB, for example surface mounting and flip-chip bonding techniques. It should be understood that, although the present invention is described using reference to EEPROMs, the use of other types of programmable memory, such as Random Access Memory (RAM), Programmable Logic Arrays (PLAs), Field Programmable Gate Arrays (FPGAs), etc. is within the scope of the present invention.

Provision of a wireless interface means that the internal functions of the device 10 can be accessed and reprogrammed, either at the factory or by the end user, using wireless signals and a suitable programming device (not shown). This allows the existing programmed configuration (i.e. the control signatures) of the light emitting elements 12 as stored, for example, in the EEPROM 44, to be modified, thereby allowing the character of the light emitting elements 12 to be modified. Additionally, and most importantly, the provision of a wireless interface allows direct or indirect feedback from the light emitting elements 12 using the wireless interface in both receiver and transmitter mode. Additionally, provision of a wireless interface 48 allows for other types of data, for example related to weather or the like, to be uploaded to the device 10 and stored in the EEPROM 44 (or RAM if it is present). Uploading could be, for example, via the wireless interface 48 from a suitably equipped PDA, notebook computer or the like. Additionally, the data stored in the device 10 during a previous uploading step could be downloaded to a suitable device, such as a PDA, notebook computer or the like for reading or further processing. It will now be apparent to persons of ordinary skill in the art that provision of general uploading and downloading capabilities would allow the device 10 to function as an easily detectable means for transferring data between parties, for example by leaving the device 10 in a visible location for a different party to find.

Four (4) different wireless interfaces are described hereinbelow as examples including:

interface using visible light signals;

interface using infra-red or near infra-red signals;

interface using infrared and visible laser signals; and interface using radio frequency (RF) signals.

However, it should be understood that these embodiments are illustrative and should not be construed as limiting the scope of the invention to these particular embodiments. Other examples could include, for example, ultra-sonic waves or an interface which takes advantage of current induction.

The above wireless signal types all have their particular advantages and disadvantages, and are used in certain ways, to achieve the desired interfacing function. In general, it can be said that all the wireless interfaces have one great advantage in that they allow access to the internal functions of the device 10, which are typically hermetically sealed within the device housing, without requiring breaking of the hermetic seal. Another significant advantage is that this access can in many cases be done from a remote location.

A number of interfacing modes between a device 10 and programming device (not shown) are foreseen. In some of the modes, and as will be pointed out below, the programming device is simply another device 10. These interfacing modes include:

cloning mode;
simple programming mode;
friend or foe identification mode;
target acquisition mode; and
remote electronic programming mode.

Typically, a particular device 10 will be equipped with the requisite functionality to support only one of the above interfacing modes, although it is possible that multiple interfacing modes may be supported in an enhanced device. The interfacing mode may be activated in a variety of ways, for example by provision of a user selectable switch on the device housing, etc. In one particular embodiment the device 10 is placed in interfacing mode by reversing the polarity of the battery 28, carried out by simply removing the battery compartment cap 18 and removing, reversing and reinserting the battery 28 in the battery compartment 16. At this point, for example, the memory bank within which the control signature would be stored would be selected using the rotary switch 20. Of course, provision of electronics supporting the battery reversal will be required, as well as an indication to the CPU 42 that the reversal has taken place.

Cloning Mode

Referring back to FIG. 2*a*, the cloning mode provides the user the ability to modify the emission (control) signatures on a repeated basis. In this regard, emission (control) signatures include the pre-programmed sequences with which the light emitting devices 12 are activated (flashed), as well as their colours and intensities as available. Generally, when in the cloning mode, the device 10 is able to switch between a record mode and playback mode to record and playback the signatures of other devices 10, or a programming device (not shown). A primary component in a first embodiment of the wireless interface for the cloning mode is a photosensitive element 56, for example a photoresistor, photodiode, phototransistor or the like. The photosensitive element 56 is illustratively operable in both the visible and invisible infra-red bands, which is capable of detecting the emission (control) signatures generated by another device 10 or a programming device.

In an illustrative embodiment of the cloning function, on activation of the cloning function the device 10 commences a cloning enable delay of 3 to 5 second, with a very short pulse on one or more of the light emitting devices 12 visible to the end user. In this manner the status of the reprogramming state is made available to the user. During this delay, the device 10 senses an input signal from the other device 10 which activates its recording period. If a recording signal is not received, the device automatically switches to playback mode where a default signature or last reprogrammed sequence will be displayed by the light emitting devices 12. If an appropriate signal is received during the record enable delay, the device 10 will display two short visible pulses via one or more of the light emitting devices 12 confirming that the recording period as begun. The recording period is directly proportional to the memory space available for reprogramming, and can be from seconds to minutes in length. In the cloning mode, as the name suggests, it is suitable for replicating signatures from other lights, remote controls or other light emitting devices.

Similarly, series of sequences making up signatures can be recorded from a PDA or similar device with an infra-red interface port. These sequences or signatures would, for example, be listed on a menu where they can be selected and sent to the device 10 via the infra-red port. The type of signature sequence which can be recorded is almost limitless.

In an alternative embodiment of the cloning mode, a RF wireless interface is used to transfer control signatures from a programming device (not shown, for example, another device or properly equipped PDA or the like) to the device 10. In one variant of this alternative cloning mode, the device 10 when placed in the cloning mode would simply illuminate the light emitting devices 12 according to the control signature received from the programming device via the RF interface. This would allow, for example, a plurality of devices 10 placed in a cloning mode to be remotely illuminated by a programming device in accordance with control signatures transmitted by the programming device.

Simple Programming Mode

As with the cloning mode, the simple programming mode can be activated, for example, by reversal of the polarity of the battery 28 (although other means, such as a switch on the device housing are also possible), combined or with the selection of a particular position on the rotary switch 20. In a first series of switch positions, the device 10 can be programmed with user defined signatures. In its simplest form, a manually operated programming device, such as a flashlight, laser pointer or the like (all not shown), is used to program the device 10 by directing the programming device at the photo sensitive element 56 and repeatedly switched on and off to create a sequence which is simultaneously stored within the device's memory. Alternatively, the pre-programmed sequences stored in a separate device as in 10 could be transferred to the device 10 in the same manner. This sequence may then be consecutively repeated over an over to form an ongoing signal. Any device which emits light would be suitable for programming the device 10 in the cloning mode. Additionally, in a particular embodiment a strong light source (not shown), such as the sun or an incandescent bulb, can be used to program the device 10 simply by covering the photo sensitive element 56, for example using the hand, and exposing the element 56 intermittently to the strong light source.

The simple programming mode also provides the user with the ability to modify the intensity of the light emitting devices 12. For example, selection of a particular position on the rotary switch 20 while in the simple programming mode (i.e. with reversal of the battery 28) would cause a particular bank of light emitting devices 12 to sequentially emit light of varying intensities. When the wished for intensity is displayed, the intensity is selected, for example, by exposing the photo sensitive element 56 to a bright source of light, which would then cause the microprocessor 42 to store the selected intensity into memory. This intensity would then be used, for example, as the intensity of the particular bank of light emitting devices 12 when emitting a signature.

It should be understood that this function of reprogramming is used to customise the light's sequences while it is not in an operational mode. It is one of the passive interactive modes, in terms of use.

Figure 3:
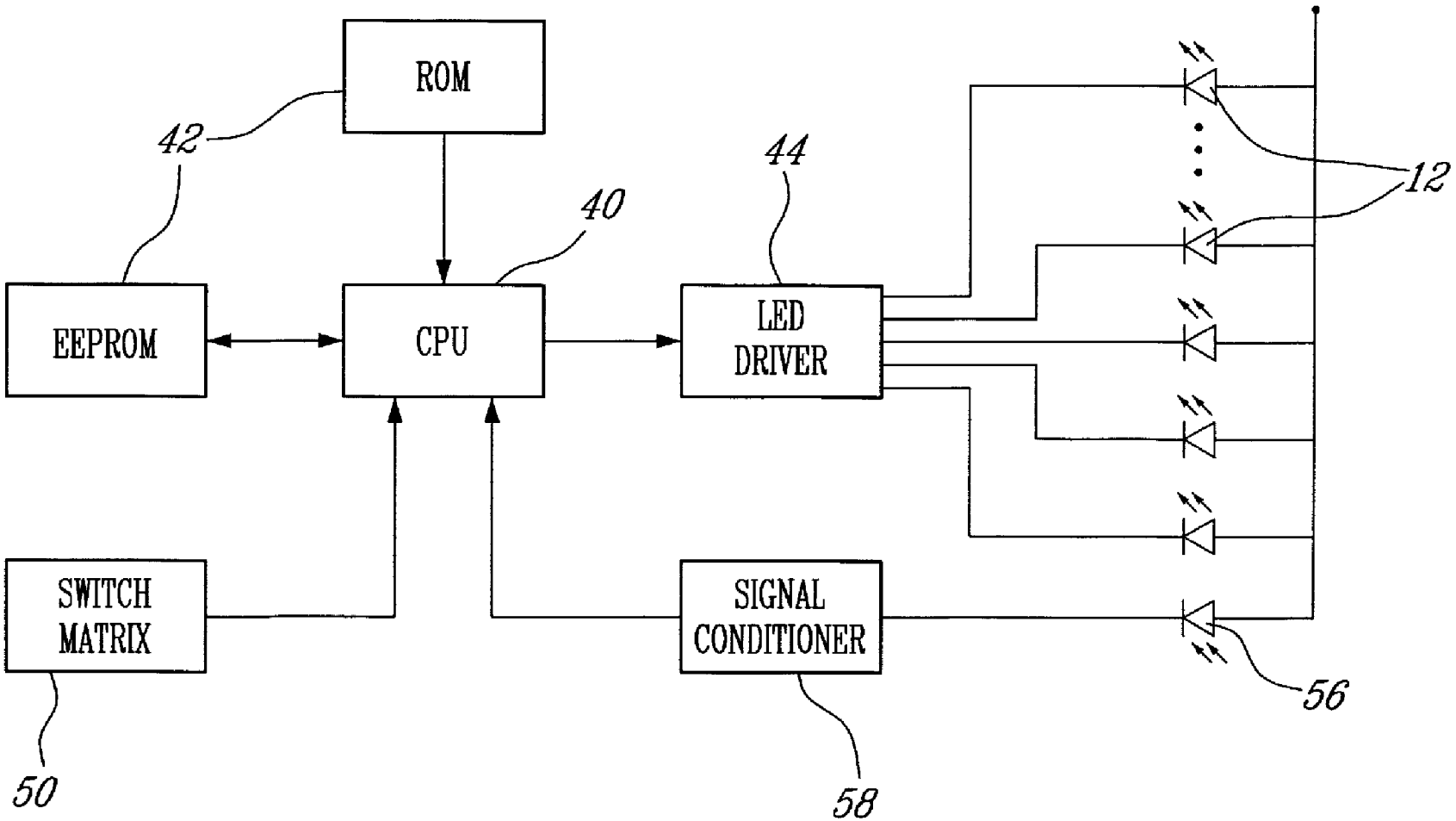
FIG. 3 is a block diagram of the electronics of a multifunction multi-spectrum signalling device in accordance with an alternative illustrative embodiment of the present invention.

Referring now to FIG. 3, signals received by the photo sensitive element 56 are typically conditioned by a signal conditioner 58 which amplifies faint signals and otherwise formats received signals so that they can be readily understood by the on board electronics. The signal conditioner 58 can also include a filtering stage (not shown) in order to extract received signals in situations where ambient light is strong, or to allow only particular wavelengths of light to be further processed into formats which are understood by the onboard electronics. For example, in cases of high ambient light it may be that the ambient light dominates the photo sensitive element 56 such that the extraction of a signal received from a laser (not shown) directed at the photo sensitive element 56 is difficult. By providing a filter for removing a portion or all of the ambient light, the laser signal can be more readily extracted. Alternatively, the photo sensitive element 56 can be selected such that only particular wavelengths of light are detected. Additionally, the format of the received signals varies depending on the type of interface being used. For example, if a portable PDA is used to communicate with the device 10 via the photo sensitive element 56, an IRDA protocol decoder is required. In many other cases, square pulse reconstruction is sufficient as input to the microcontroller (CPU) 42. The CPU will then analyse these input signals according to a program stored in the ROM/EEPROM 44, and store any new signalling information in the EEPROM 44. This configuration can include not only the information transferred via the photo sensitive device 56 but also the position of the switch which is determined from the switch matrix 50.

Friend or Foe Identification Mode

The friend or foe identification mode provides another possible manner in which remote interaction with devices using wireless signals can take place while the device is in use. This mode enables the user to set the device to a desired function while waiting for a wireless signal confirmation of identification.

Positive feedback of identification can be achieved by remotely modifying the pre-programmed signatures of sequence devices 10, using, for example, a coded infra-red transmission to multiple devices as in 10. As an example, members of one team who are each wearing one of the devices 10 can be identified as their devices 10 turn on automatically upon receiving of the coded infra-red transmission from a remote transmitter. This feature can be used, for example, for delivering a visual (or covert) confirmation to both the end user, who now knows he has been identified by the remote transmitter, and the operator of the remote transmitter, who is trying to identify members of the particular team.

It should be understood that although the above mode relies on a wireless infra-red transmission, the same interaction could also be achieved with other wireless signals, such as RF or ultra-sonic waves.

Target Acquisition Mode

The target acquisition mode is also an active mode where communication with the device 10 is achieved during normal light operation. As known in the art, many target acquisition systems are based on lasers, operating in either the visual or infra-red spectrum, which are focused on the target in question, thereby providing laser guidance, for example, for a weapons operator trying to engage a target, or ordinance capable of targeting on the laser. In order to support the target acquisition mode, the device 10 is equipped with a receiver tuned to the acquisition system's laser.

As an example, a device 10 could be a attached to a target with the device 10 set to a predetermined flashing signature mode, for example a repetitive flash of 2 Hz. As the light emitting devices 12 are flashed according to the control signature, the device 10 would also wait for the targeting system's laser to strike the photo sensitive element 56. Once the targeting laser strikes the photo sensitive element 56, the device 10 would change from the 2 Hz flashing mode to, for example, a steady-on, thereby providing a visual indication that the correct target had been acquired. In a particular illustrative embodiment the device 10 is capable of receiving via the photo sensitive element 56 and decoding signals emitted by a targeting laser operating at 1550 nm which, as discussed above, is visible over great distances. Additionally, lasers are typically not steady state, but rather emit a train of pulses of laser light. The frequency, duty cycle, etc., of the pulses varies from laser to laser but is typically above 30 Hz. In order to detect the frequency of the pulse train being emitted by the laser, the signal conditioner 58 would include a pulse filtering stage designed to detect the frequency of the laser pulse train. This second filtering stage would provide the device 10 with some ability to differentiate between laser emissions from different systems. Additionally, the pulse filtering stage could be enhanced to detect encoded laser pulse trains, thereby providing additional security that the device 10 will only be activated by those lasers with which it is intended to illuminate the device 10.

Landing Ingress/Egress Acquisition and Confirmation Mode

This mode is primarily foreseen for situations involving remote landing sites or landing zones. As provision of the wireless interface allows one or more of the devices as in 10 to be remotely controlled, one or more of the devices as in 10, placed earlier in the landing zone, can be used to provide an airborne vehicle, such as a helicopter, with a visual identification of a landing zone only on request of the pilot. It will be apparent now to a person of ordinary skill in the art that the pilot in such a situation may remotely control the devices as in 10, either individually or in groups, for example to light up a runway or emit visual codes for landing, or to avoid landing, and to change light colours or intensities.

Remote Electronic Programming Mode

The remote electronic programming mode allows the device 10 to be reprogrammed via a wireless RF interface (although this could also be achieved by infra-red or other wireless means). In the present embodiment reprogramming of the device 10 is achieved through a combination of wireless digital data transfer and programming of the integrated circuits within the device 10.

Provision of direct wireless IC reprogramming allows the signatures used to drive the light emitting devices 12 held within the device 10 to be modified, for example by modifying the pulse duration, pulse frequency, intensity of the light emitting devices, and even colour. It will be apparent now to a person of ordinary skill in the art that a large number of permutations and combinations are possible with provision of the above features.

The remote electronic programming mode has a number of advantages, especially during manufacturing. For example, during fabrication a device 10 be preprogrammed with a default set of signatures. If a particular client requests a particular signature set, the device 10 may be reprogrammed using remote electronic programming mode to include this particular signature set.

Figure 4:
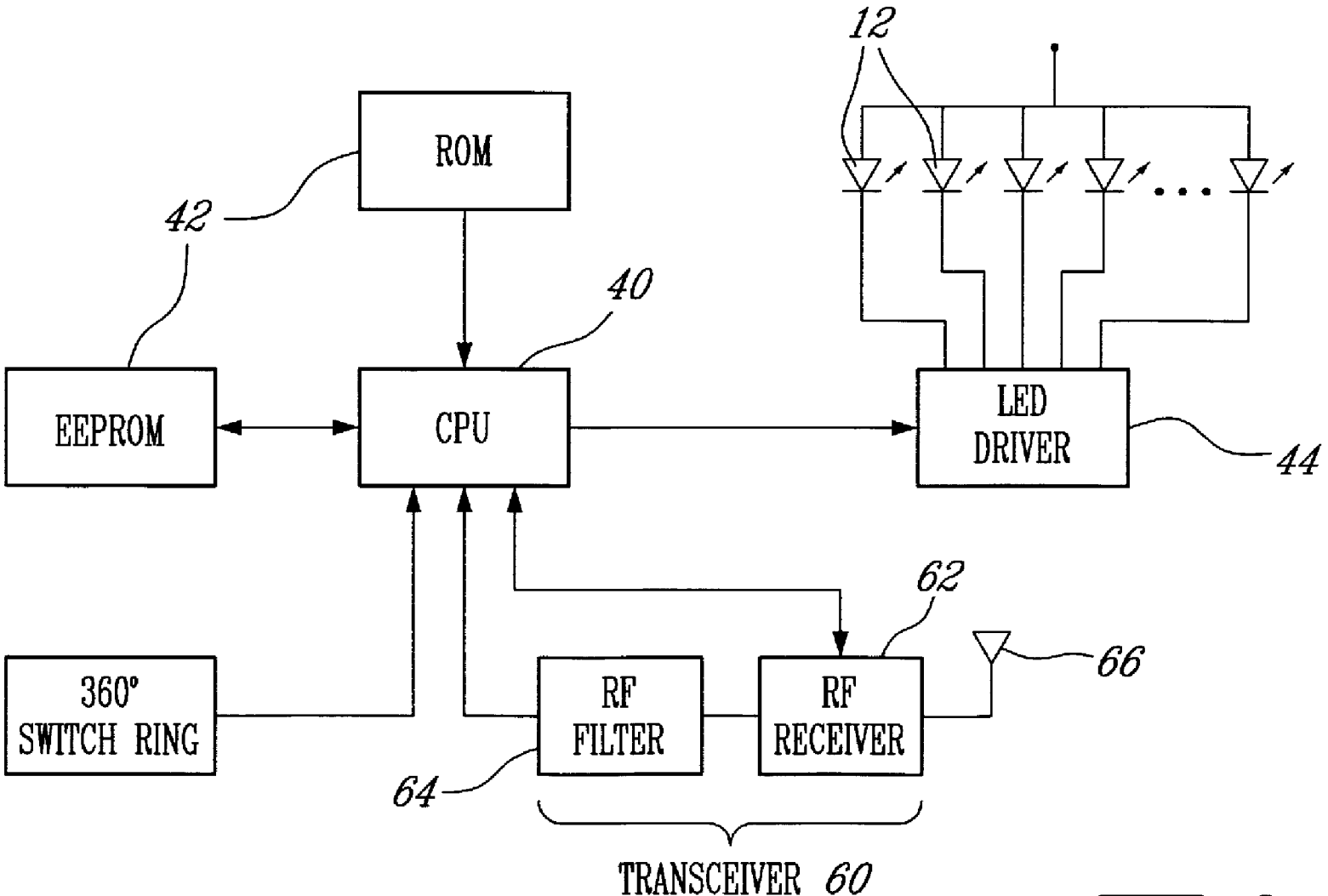
FIG. 4 is a block diagram of the electronics of a multifunction multi-spectrum signalling device in accordance with a second alternative illustrative embodiment of the present invention.

Referring to FIG. 4, In order to support the remote electronic programming mode, the device 10 would require, for example, the addition of a digital transceiver 60, a CPU 42 with sufficient EEPROM memory 44 as well as the requisite program for receiving and storing the reprogramming instructions via the digital transceiver 60. Additionally, a wireless reprogramming device (not shown) would also be required.

Still referring to FIG. 4, the digital transceiver 60 is comprised of a RF receiver 62 and RF filter 64 pair that interconnects with a transmitting device (not shown) via an antenna 66. Depending on application the antenna could be either external to the device 10 or encapsulated there within. The RF receiver would typically be tuned to a pre-selected frequency, for example selected within the band from 400 MHz and 2.4 GHz. The received digital signals are demodulated and filtered to provide a digital sequence which is provided as input to the CPU 42 which in turn analyses the sequences according to a program stored in the ROM/EEPROM 44. Data received via the RF interface comprises control data related to signatures and memory locations into which the signatures are to be stored. This provides the user with the ability to over write signatures currently stored in the EEPROM 44 with new signatures.

Referring back to FIG. 1, in this mode, provision of control over the signatures which are used to drive the light emitting devices 12 remotely allows the manufacturer (or the ultimate end user) to modify the personality of the device 10 to suit a user's needs. Control over multiple light emitting devices 12 (for example LED, incandescent, Xenon or otherwise) inside the device offers a large degree of flexibility. For example, a device 10 comprised of three or six position rotary switch 20 can be manually actuated to activate several preprogrammed functions, alternately these same preconfigured functions can be changed so the manually activated or switched function changes. Alternately, the device 10 can be overwritten out of manual control and controlled directly and remotely to activate a large number of different signatures, changed by the user at will. Provision of this type of remote control extends the number of pre-programmed signatures which may be used to drive the light emitting devices 12 such that the number of signatures available are many times more than those which would otherwise be available by rotating the rotary switch 20. Indeed, the number of signatures would be limited only by the amount of available memory.

A large number of applications are foreseeable for the present invention. For example, one initial application consists of Friend and Foe identification in hostile environments. Remote aircraft, mechanised ground units and even soldiers themselves could activate the device 10 via the wireless interface using a suitable remote transmitter and specialised security codes, with the codes activating pre-programmed signatures stored in the lights. Additionally, security can be ensured through the use of digital coding and encryption. The devices could also have their programs modified on a mission by mission basis, allowing customisation for the next mission or application.

Figure 5:
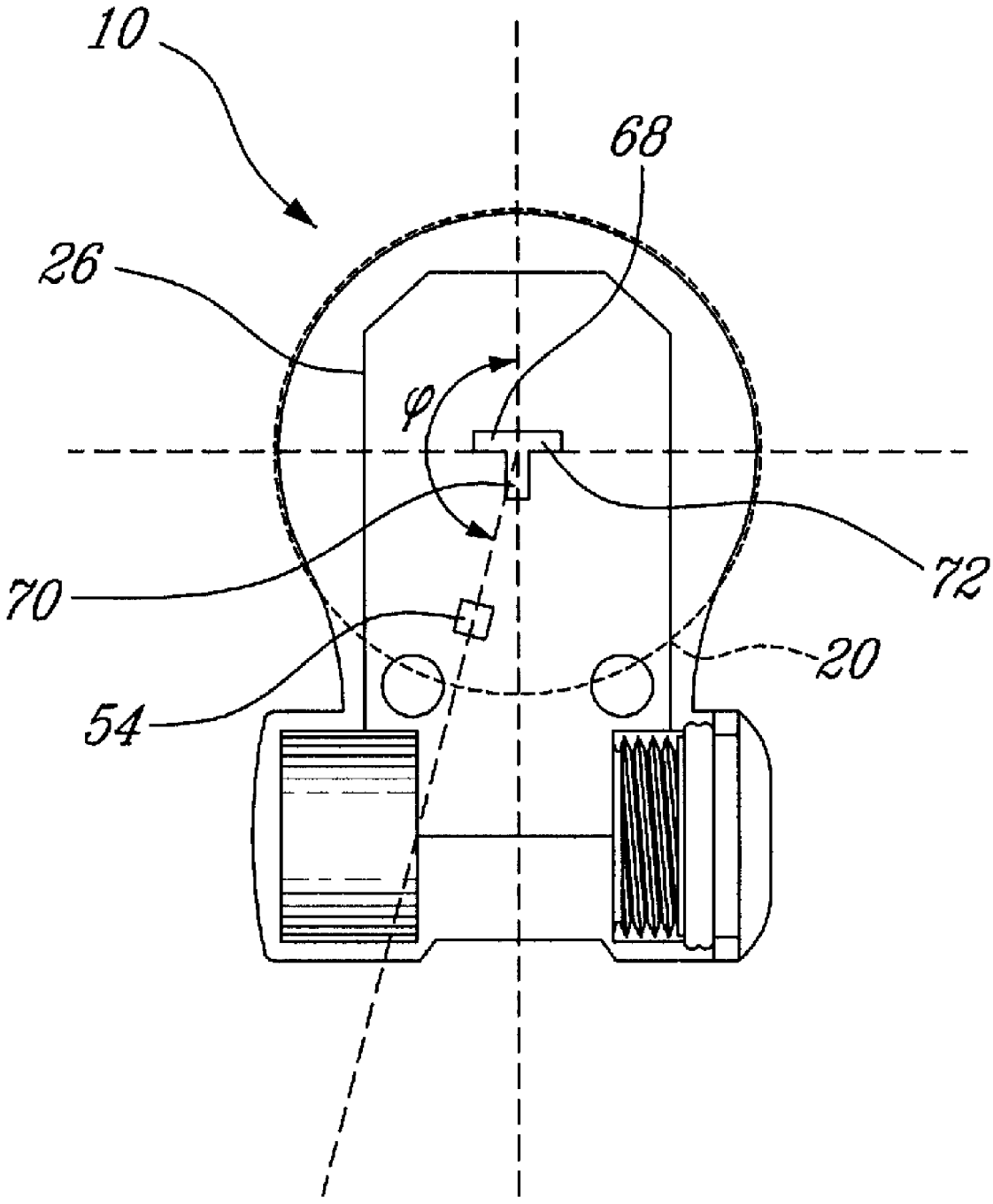
FIG. 5 is a rear plan view of a multifunction multi-spectrum signalling device with the housing removed in accordance with a third alternative illustrative embodiment of the present invention.

Referring to FIG. 5, alternatively the disclosed limited four (4) position rotary switch on the device 10 could be replaced with a rotary switch comprised of a 360° switch ring position detector. A pair of oriented hall effect sensors 68, 70 are positioned on the PCB 26 proximate to the point 72 where the axis of rotation of the rotary switch 20 intersects the PCB 26. As the rotary switch 20 is rotated about the point 72 the magnet 54 follows a circular path with the point 72 at its centre. With the provision of the appropriate electronics, combination of the outputs of the hall effects sensors 68, 70 can be used to determine the position of the magnet 54 at any point along this path, and therefore the angular rotation $\phi$ of the rotary switch 20. It will now be apparent that the rotary switch can define a large number of switch positions limited only by the resolution of the angular rotation $\phi$ detected by the hall effects sensors 68, 70 and their associated electronics. For example, with provision of an appropriate tactile feed back to the user on rotating the rotary switch 20, 36 different positions could be defined, one for each 10 degrees of angular rotation, allowing, for example, for one of 36 different signatures to be activated with rotation of the rotary switch 20 to an appropriate angle.

Although the present invention has been described hereinabove by way of an illustrative embodiment thereof, this embodiment can be modified at will without departing from the spirit and nature of the subject invention.

What is claimed is:

1. A user interface for an electronic device, the interface comprising:

first and second parts arranged for relative displacement, said first part comprising a magnet and said second part comprising a first hall effect sensor for sensing a displacement of said magnet along a first axis and a second hall effect sensor for sensing a displacement of said magnet along a second axis, wherein said magnet moves relative to said first and second hall effect sensors in response to movement of said second part relative to said first part;

a plurality of switch settings, each of said switch settings comprised of a unique combination of a magnet position along said first axis and a magnet position along said second axis; and control electronics coupled to said first and second hall effect sensors for converting the combination of a current position of said magnet along said first axis and a current position of said magnet along said second axis into a selected one of said plurality of switch settings.

2. The interface of claim 1, wherein said magnet is limited to movement along a circle centred on said third axis.

3. The interface of claim 1, wherein said first axis is perpendicular to said second axis.

4. The interface of claim 1, wherein said first and second hall effect sensors are oriented hall effect sensors.

5. The interface of claim 4, wherein said first and second hall effect sensors are positioned at said third axis.

6. The interface of claim 1, wherein said first part is limited to rotation relative to said second part about said third axis.

7. The interface of claim 1, wherein movement of said first part relative to said second part is limited using tactile feed back.

* * * * *